US006703547B2

(12) United States Patent
Hovermann, Jr. et al.

(10) Patent No.: US 6,703,547 B2
(45) Date of Patent: Mar. 9, 2004

(54) TUNING PEG CONSTRUCTION

(76) Inventors: Fred G. Hovermann, Jr., 30 Arcadia Pl., Vineland, NJ (US) 08360; Peter J. Ferrara, 62 Water St., Barnegat, NJ (US) 08005

( * ) Notice: Subject to any disclaimer, the term of this patent is extended or adjusted under 35 U.S.C. 154(b) by 0 days.

(21) Appl. No.: 09/976,355

(22) Filed: Oct. 12, 2001

(65) Prior Publication Data

US 2003/0070529 A1 Apr. 17, 2003

(51) Int. Cl.[7] ..... G10D 3/14
(52) U.S. Cl. ..... 84/304; 84/305; 84/306
(58) Field of Search ..... 84/306, 304, 305

(56) References Cited

U.S. PATENT DOCUMENTS

| | | | | | |
|---|---|---|---|---|---|
| 1,443,486 A | | 1/1923 | Lindstrom | | |
| 3,830,132 A | | 8/1974 | Lowe | | 84/304 |
| 4,528,887 A | * | 7/1985 | Frederick | | 84/306 |
| 5,018,424 A | * | 5/1991 | Steinberger | | 84/304 |
| 5,097,736 A | * | 3/1992 | Turner | | 24/71.1 |
| 5,103,708 A | | 4/1992 | Steinberger | | 84/304 |
| 5,277,095 A | * | 1/1994 | Steinberger | | 84/304 |
| 5,381,715 A | | 1/1995 | Spercel | | 84/304 |

* cited by examiner

*Primary Examiner*—Kim Lockett

(57) ABSTRACT

An improved tuning peg construction 10 for applying selective tension on a string 101 of a musical instrument 100 wherein the construction includes a tuning peg member 20 having a threaded shaft 21 adapted to engage the toothed gear 103 on a tuning peg 102 attached to one of the string 101 of a musical instrument; wherein, the outboard end of the tuning peg member 20 is provided with a contoured post 20 that is received in a reciprocating fashion in a contoured recess 34 formed in a tuning knob member 30 which is normally spring biased into a free-wheeling spaced relationship with the tuning peg member 20 until such time as the musician desires to change the tension on the string 101 of the instrument 100.

7 Claims, 1 Drawing Sheet

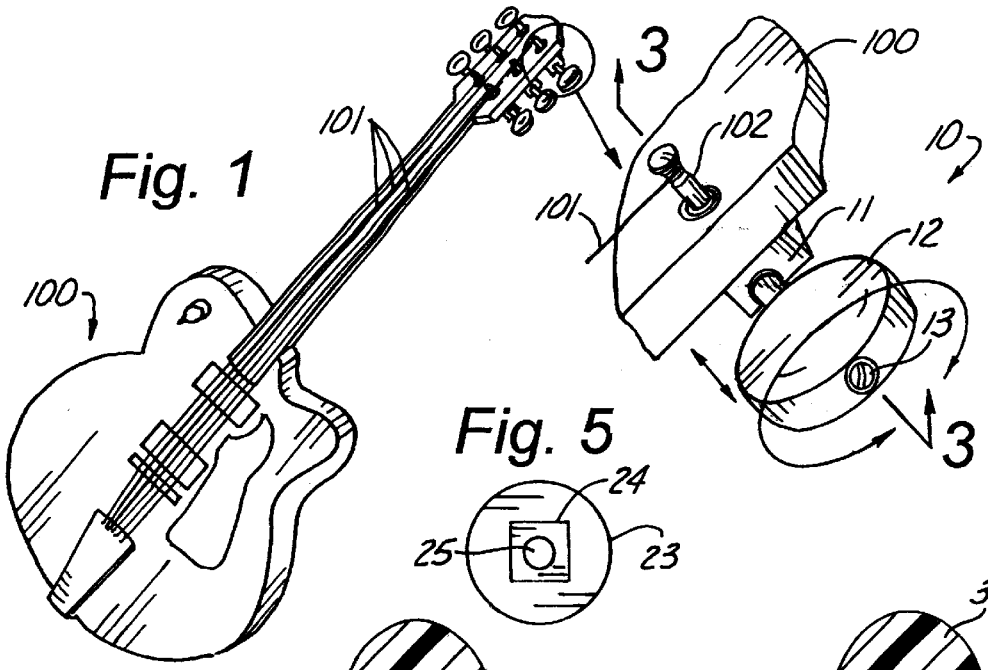
Fig. 1
100
101
3
100
102
10
101
11
12
13
3
Fig. 5
24
25
23
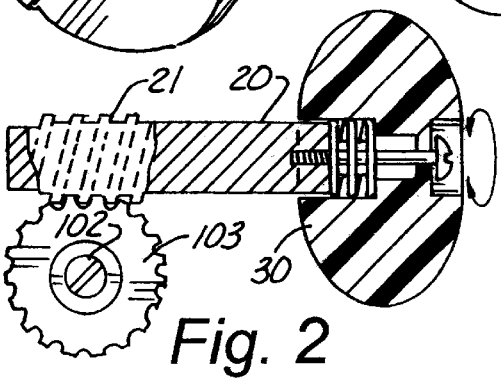
21
20
102
103
30
Fig. 2
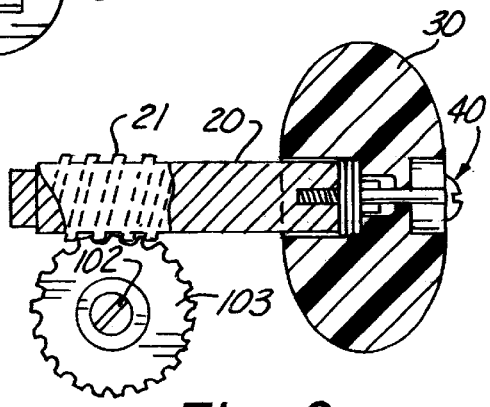
30
21
20
40
102
103
Fig. 3
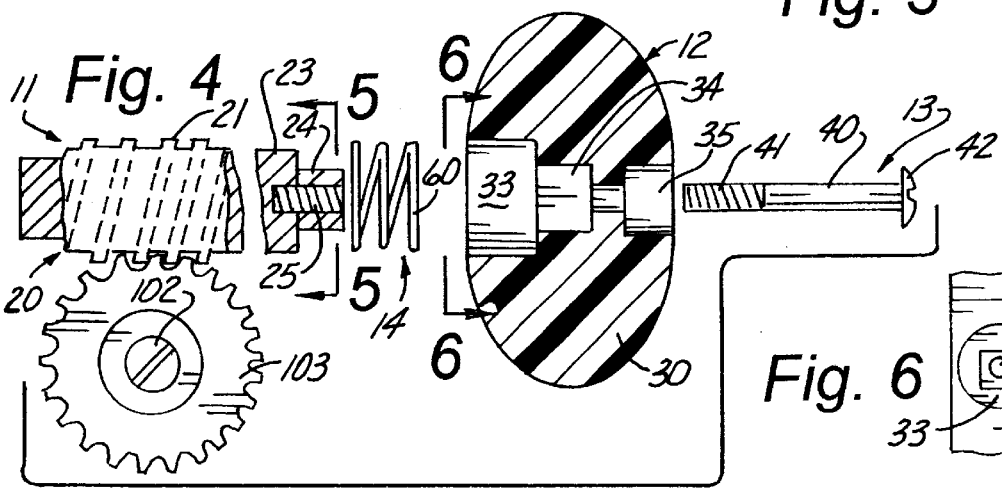
Fig. 4
11
21
23
24
5
6
12
34
35
41
40
13
42
60
33
25
5
14
6
20
102
103
30
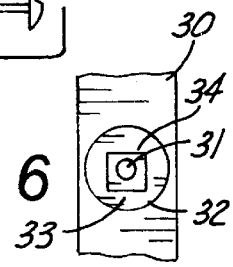
Fig. 6
30
34
31
32
33

TUNING PEG CONSTRUCTION

CROSS REFERENCE TO RELATED APPLICATIONS

Not applicable.

BACKGROUND OF THE INVENTION

1. Field of the Invention

The present invention relates to the field of tuning peg constructions in general and in particular to freely rotating tuning plug constructions that must be manipulated in a particular manner to effect the tuning of a musical instrument.

2. Description of Related Art

As can be seen by reference to the following U.S. Pat. Nos. 4,367,671; 1,443,486; 5,381,715; and, 3,830,132, the prior art is replete with myriad and diverse musical instrument tuning devices.

While all of the aforementioned prior art constructions are more than adequate for the basic purpose and function for which they have been specifically designed, they are uniformly deficient with respect to their failure to provide a simple, efficient, and practical tuning peg construction which, once adjusted, will immediately revert to a free-wheeling mode so that the peg setting cannot be accidentally displaced to get the instrument out of tune.

As most musicians are all too well aware, one of the most difficult and vexing problems that they encounter in their musical pursuits is the task of keeping their string instruments in tune.

Invariably, when using conventional tuning pegs which are tightened or loosened to achieve the proper tuning of the string, the tightening mechanism becomes displaced during transport or handling requiring repeated re-tightenings of the instruments.

As a consequence of the foregoing situation, there has existed a longstanding need among musicians for a new and improved tuning peg construction that once properly adjusted assumes a free-wheeling mode that prevents any inadvertent displacement of the tuning peg; and, the provision of such a construction is the stated objective of the present invention.

BRIEF SUMMARY OF THE INVENTION

Briefly stated, the improved tuning peg construction that forms the basis of the present invention comprises in general a peg unit, a tuning knob unit, an axle unit and a spring biasing unit wherein the spring biasing unit surrounds the axle unit which provides the operative connection between the peg unit and the tuning knob unit so that the knob unit can be free-wheeling or selectively engaged with the tuning peg unit.

As will be explained in greater detail further on in the specification, the tuning peg unit includes a tuning peg member having a threaded shaft that engages a toothed gear attached to the conventional tuning peg to vary the tone of the string wherein the other end of the tuning peg member is provided with a contoured post that is selectively engaged by a portion of the knob unit.

The knob unit includes an enlarged knob member having an elongated aperture dimensioned to receive the axle unit and allow for reciprocation of the knob member relative to the axle unit; wherein the inboard end of the knob member is provided with a contoured recess dimensioned to frictionally receive the contoured post of the tuning peg member to rotate the tuning peg member relative to the musical instrument.

In addition, the spring unit surrounds the axle unit and normally biases the knob member into a free-wheeling disengaged relationship relative to the tuning peg member to maintain the position of the tuning peg member relative to the tuned string on the instrument.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of a conventional string instrument equipped with the improved tuning peg construction that forms the basis of the present invention;

FIG. 2 is a cross-sectional view of the construction in its free-wheeling mode;

FIG. 3 is a cross-sectional view of the construction in its tuning adjustment mode;

FIG. 4 is an exploded perspective view of the construction;

FIG. 5 is an end view as seen through line 5—5 of FIG. 4; and,

FIG. 6 is as seen through line 6—6 of FIG. 4.

DETAILED DESCRIPTION OF THE INVENTION

As can be seen by reference to the drawings, and in particular to FIG. 1, the improved tuning peg construction that forms the basis of the present invention is designated generally by the reference number 10. As shown in FIG. 4, the construction 10 comprises in general a tuning peg unit 11, an adjustment knob unit 12, an axle unit 13, and a spring bearing unit 14. These units will now be described in seriatim fashion.

Prior to embarking on a detailed description of the invention, it would first be advisable to describe the environment in which it is employed. As shown in FIG. 1, string instruments 100 have a plurality of strings 101 wherein the individual strings 101 are connected to tuning pegs 102 whose lower ends are disposed in toothed gears 103. As can be seen by reference to FIGS. 2 through 5, the tuning peg unit 11 comprises a tuning peg member 20 having an elongated threaded shaft 21 which engages the toothed gear 103 to rotate the tuning peg 102 in either a clockwise or counterclockwise direction to modulate the string tone.

In addition, the outboard end of the threaded shaft 21 has an enlarged cylindrical collar 23 provided with a centrally disposed outwardly projecting rectangular post 24 having an elongated threaded central aperture 25 that extends at least into the enlarged cylindrical collar 23 for reasons that will be explained presently.

Turning now to FIGS. 2 through 6, it can be seen that the knob unit 12 comprises an enlarged bore 31 wherein the inboard end of the central bore 31 is provided with a dual stage stepped shoulder counterbore formed in a cylindrical projection 32 defining an outer enlarged cylindrical recess 33 and a reduced dimension generally rectangular inner recess 34 dimensioned to receive the outwardly projecting rectangular post 24 on the tuning peg member 20 in a well recognized fashion.

In addition, the outboard end of the central bore 31 is provided with a tapered counterbore 35 whose purpose and function will be described presently.

As can best be seen by reference to FIG. 4, the axle unit 13 comprises an elongated rod member 40 having a threaded inboard end 41 and an enlarged tapered slotted head 42 formed on the outboard end; wherein the threaded inboard end 41 is adapted to engage the threaded aperture 25 in the post 24 on the peg member 20 and the tapered slotted head 42 is dimensioned to be received in the outboard tapered counterbore 35 in the knob member 30.

As can also be seen by reference to FIG. 4, the spring biasing unit 14 comprises a helical spring member 60 that is disposed in a surrounding relationship with the inboard end of the rod member 30 for normally biasing the knob member 30 into a freely rotatable relationship with the tuning peg member 20.

By now, it should be appreciated that as shown in FIGS. 1 through 3, the normal disposition of the knob member 30 relative to the tuning peg member 20 is in a free-wheeling rotatable relationship due to the influence of the spring member 60. However, when the musician wishes to change the tuning of a particular string 101, all that is required is to press the knob member 30 inwardly against the influence of the spring member 60 so that the rectangular recess 34 is placed into registration with the rectangular post 24 on the outboard end of the tuning peg member 20 so that the tuning peg member 20 can be rotated in either a clockwise or counterclockwise direction to vary the tension on the musical string 101.

Then when the string 101 has been properly tuned, the knob member 30 is released to return to the free-wheeling mode so that any inadvertent contact with the knob member 30 will have no influence whatsoever on the setting of the tuning peg member 20.

It should also be appreciated at this juncture that while the post on the tuning peg member and the inboard counterbore on the knob member have been described as having complementary rectangular configurations, other non-cylindrical complementary geometric configurations would work as well in keeping with the teachings of this invention.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. An improved tuning peg construction for controlling the tension on the individual strings of a string instrument wherein, the construction comprises a tuning peg unit including a tuning peg member including an elongated shaft having an inboard end provided with threads and an outboard end provided with a reduced diameter contoured post a knob unit including a knob member provided with a stepped shoulder recess having a first portion dimensioned to loosely surround said contoured post and having a second portion dimensioned to frictionally engage said contoured post an axle unit including an elongated rod member operatively connecting the knob member to the tuning peg member; and, a spring biasing unit including a spring member disposed within the knob member and adapted to normally bias the contoured post member away from engagement with the second portion of the stepped shoulder recess in the knob member.

2. The construction as in claim 1; wherein, the spring member is disposed in a surrounding relationship relative to a portion of the elongated rod member.

3. The construction as in claim 1; wherein, the spring member is captively engaged in the first portion of said stepped shoulder recess.

4. The construction as in claim 2; wherein, the spring member is captively engaged in the first portion of said stepped shoulder recess.

5. The construction as in claim 1; wherein, the knob member is adapted to move in a reciprocable fashion relative to the elongated rod member.

6. The construction as in claim 1; wherein, the knob member is adapted to freely rotate relative to the elongated rod member.

7. The construction as in claim 5; wherein, the knob member is also adapted to freely rotate relative to the elongated rod member.

* * * * *